US005884770A

United States Patent [19]

Galm

[11] Patent Number: 5,884,770

[45] Date of Patent: Mar. 23, 1999

[54] GREETING AND THEMATIC CARDS AND KIT

[75] Inventor: Edward L. Galm, Cockeysville, Md.

[73] Assignee: Creative Horizons, LLC, Baltimore, Md.

[21] Appl. No.: 766,481

[22] Filed: Dec. 4, 1996

(Under 37 CFR 1.47)

[51] Int. Cl.[6] ..... B65D 65/02

[52] U.S. Cl. ..... 206/575; 206/232; 40/124.19; 40/124.08

[58] Field of Search ..... 206/575, 577, 206/232; 40/124.19, 124.08, 124.14, 124.16, 539

[56] References Cited

U.S. PATENT DOCUMENTS

| | | | |
|---|---|---|---|
| 4,309,835 | 1/1982 | Naeve . | |
| 4,890,402 | 1/1990 | Carroll . | |
| 4,907,826 | 3/1990 | Versage . | |
| 4,949,482 | 8/1990 | Price | 40/124.08 |
| 5,226,532 | 7/1993 | Davidson et al. . | |
| 5,232,087 | 8/1993 | Schluger . | |
| 5,275,285 | 1/1994 | Clegg . | |
| 5,349,769 | 9/1994 | Okola . | |
| 5,458,235 | 10/1995 | Stone . | |
| 5,613,612 | 3/1997 | Davault | 40/124.08 |

*Primary Examiner*—Jacob K. Ackun
*Attorney, Agent, or Firm*—Browdy and Neimark

[57] ABSTRACT

A culinary greeting card kit is a boxed set of greeting cards (30) with envelopes (40) and two thematic cards, preferably recipe cards, (10, 20) for each greeting card. One recipe card (10), to be sent, is enclosed inside the greeting card and held by tabs (T); the other, identical, recipe card (20) is kept by the sender. The recipes vary from card to card and a picture of the food item made by the recipe may appear on the face of the greeting card and also on the back of each recipe card. Thus, the kit includes a variety of food pictures as well as recipes. The greeting card preferably has a pop-up section (F) traversing the recipe card, so that the card is retained under the pop-up section as well as between the tabs.

15 Claims, 2 Drawing Sheets

GREETING AND THEMATIC CARDS AND KIT

This application claims benefit of Provisional Application No. 60/030,525, filed Nov. 13, 1996.

FIELD OF THE INVENTION

The present invention relates to pop-up combination greeting cards and the like.

BACKGROUND OF THE INVENTION

The greeting card industry is a major industry with substantial competition. Greeting card companies are constantly looking for new ideas for construction and presentation which may give them a competitive edge over their competition.

Many people enjoy cooking, collecting recipes, and sharing recipes with their friends, and sending greeting cards to their friends (who may also collect recipes). A person wishing to send both a greeting card and a recipe has typically had to copy a recipe card onto the greeting card (which requires the recipient to re-copy the recipe) or else to copy the recipe onto a card and enclose the recipe card with the greeting card.

The recipient would now have a plain, uncolored, probably blue-lined index card with a hand-written recipe; it lacks anything to make it special or memorable or to cause it to stand out in the recipient's recipe card collection. It has no apparent connection to the greeting card and its sender, so after the greeting card is trashed the stored recipe card is no reminder of the sender or the greeting card. It is not an ideal gift.

The plain recipe card has no picture of the food that the recipe makes; the card will not inspire the recipient to prepare the food, so it is less likely to be used.

The hand-written, 3-by-5 card recipe is not attached and may be lost, since the greeting card may be extracted and the recipe card carelessly discarded along with the envelope. It is known to attach a smaller card, such as a business card, inside a larger bifold greeting card; U.S. Pat. No. 5,349,769 in FIG. 2 shows a greeting card with slots 20 for holding corners of a smaller business card 22, and U.S. Pat. No. 5,275,285 shows a business card 110 similarly held in a card in FIG. 4, by its corners being inserted into angled slots.

Photographs are also known to have been fastened to greeting cards. U.S. Pat. No. 4,890,402 shows a photograph 20 held to the front of bifold greeting card 12 by a transparent pocket 16.

Greeting cards with a "pop-up" feature which pops up upon opening of the card are also known.

The prior art does not disclose any way of combining greeting cards with recipe cards. Nor does it disclose any pop-up greeting card with a correlated information bearing card disposed in conjunction with the pop-up feature.

SUMMARY OF THE INVENTION

Accordingly, the present invention has an object, among others, to overcome deficiencies in the prior art such as noted above.

Another object of the present invention is to provide a combination of a pop-up greeting card with an information bearing card disposed in conjunction with the pop-up feature.

A further object of the invention is to provide a combination greeting and recipe or other food-related card, and more especially a pop-up card greeting card having a pop-up figure which interacts with a recipe or other food-related card.

Yet another object is to provide a boxed set containing a plurality of such cards of different types.

The invention thus provides a combination of a single-panel thematic card, such as a recipe or religious card, with a larger two-panel, folded greeting card, where the greeting card includes die-cut tabs or functionally similar holding means which are spaced apart by the width of the single-panel thematic card, so that the single-panel thematic card can be held within the greeting card by the tabs and discovered upon opening the greeting card.

Preferably, the greeting card is a pop-up card having a pop-up section that traverses the space between the tabs and is longer than the single-panel thematic card length or width, so that the thematic card can be placed underneath the pop-up section when held by the tabs. In this way the pop-up section of the greeting card interacts with the single-panel card to keep it from sliding out: for example, it is held by the V-fold of the two greeting card panels on the bottom, by one of the pop-up supports at the top, and by the tabs on either side. However, because the pop-up section is raised away from the greeting card panel the single-panel card can be easily removed. Furthermore, the pop-up section, which is preferably in the shape of a figure, creates a very distinctive impression, in conjunction with the single-panel card therebeneath, upon opening of the card.

Preferably, the single-panel thematic card is a recipe card. The greeting card and the recipe card have correlated indicia. For example, the face or front cover of the greeting card preferably is a photograph of the food product whose recipe is inside. The pop-up section may be a figure relating to food or cooking, such as a chef, and the indicia may also be related to food or cooking.

The greeting card is preferably formed of doubled, adhered sheets so that the tabs and the pop-up section are not visible on the outside of the greeting card when it is folded to its closed position.

The invention is further related to a boxed kit containing, first, a plurality of the greeting card—thematic card combination described above, where indicia vary from card to card but each greeting card contains a single-panel card, such as a recipe card, with indicia similar to that of the greeting card; and second, a packet of extra single-panel cards which are duplicates of the ones inside the greeting cards. Preferably, the kit also contains envelopes for the greeting cards. This kit allows a user to send different cards to various persons, each with a respective recipe card inside, for example, and to also keep a copy of each recipe card. The box is desirably a self-locking box with a hinged cover.

The invention thus cleverly combines a gift and a greeting with a novel and desirable configuration.

BRIEF DESCRIPTION OF THE DRAWING

The above and other objects and the nature and advantages of the present invention will become more apparent from the following detailed description of an embodiment taken in conjunction with drawings, wherein.

DETAILED DESCRIPTION OF PREFERRED EMBODIMENTS

Here, and in the following claims:

"Card" means a planar or sheet-like device of any outline shape bearing indicia, such as words or pictures. A "card" ordinarily will be made in whole or part of paperboard, heavy paper, photographic paper, plastic sheet, foil, but is limited to no special material. It may be creased to be folded in various ways, or un-creased and non-folding.

"Single-panel card" means a card which is un-creased and non-folding.

"Dimension" refers to the length or to the width of a rectangular card, and a larger dimension of a non-rectangular card.

"Bifold card" means any card of at least two connected panels which opens to display indicia on the inside. This term encompasses multipaged cards or multipaneled cards with a plurality of folds.

"Greeting card" means a folding card bearing indicia, especially on a front panel surface and at least one inside surface.

"Larger card" means a first card sufficiently larger than a second or smaller card so that the smaller card fits entirely onto a panel or surface of the larger card without protruding over the edge of the panel or surface of the larger card.

"Recipe card" means a card, preferably a single-panel card, having a food recipe on one of its sides or surfaces, designated as its front side. The back side may bear other indicia, such as a continuation of the recipe, a different recipe, an advertisement, a picture, etc. For example, the recipe card front side may have a recipe written thereon, with a picture of the food item prepared according to the recipe shown on the back. Front and back are relative and either may preferably face forward when in use.

"Tab means" includes any fold, any die-cut shape, or any opening in a panel of a greeting card. More specifically, it includes a tab (a convex or protruding flap under which a single-panel card edge may be held) or a slot (a cut of any shape into which a corner of a card may be slid). It may also comprise removable or reusable adhesive, hook-and-loop fasteners, and other conventional means for holding one card to another.

"Thematic card" means a card, such as a recipe card, which is one of a plurality of cards all having indicia thereon indicative of a similar theme, such as culinary, religious, relating to a specific company or firm, etc. The indicia may be text, pictures, or both.

Figure 1:
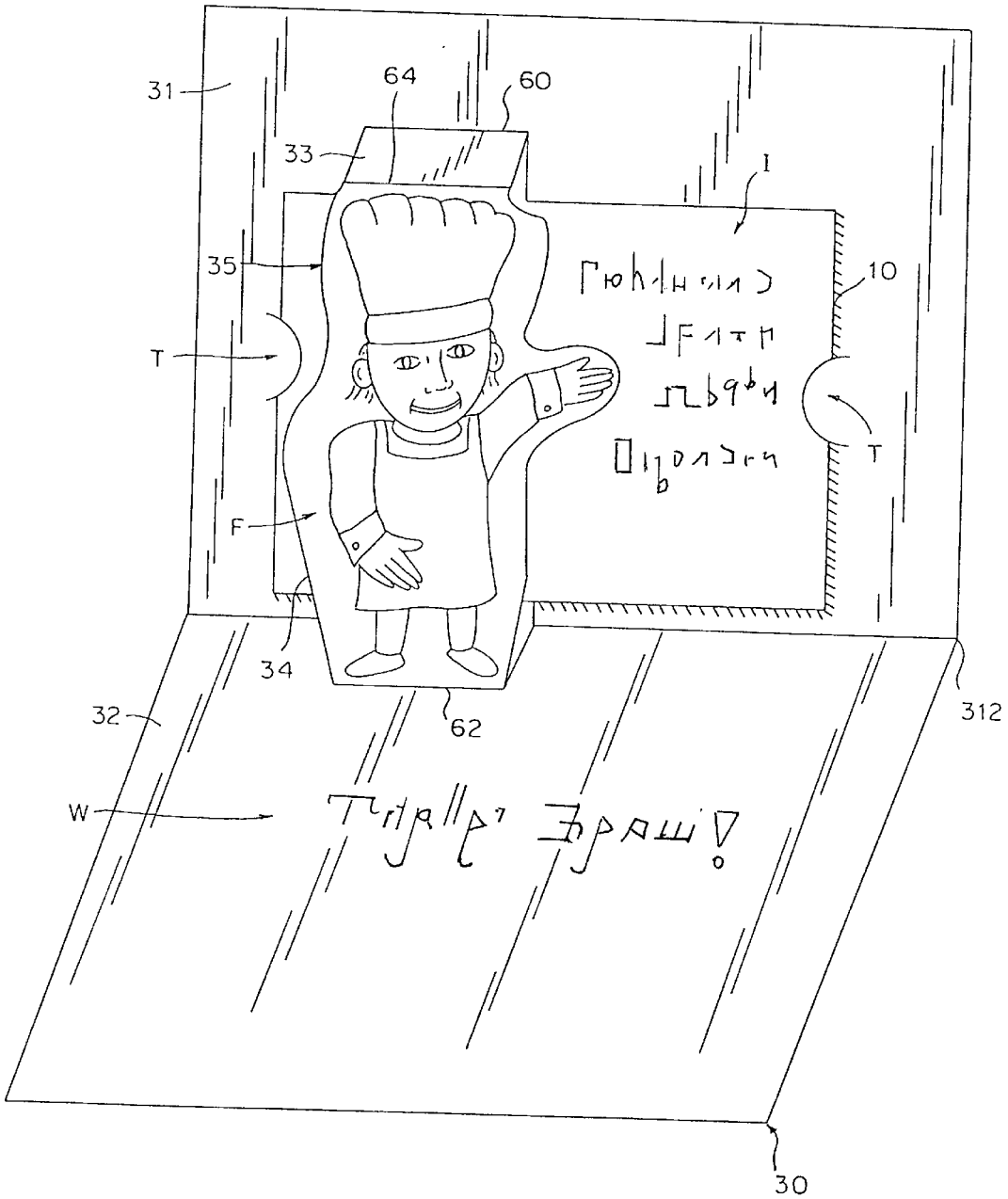
FIG. 1 is a perspective view of a combination interactive open greeting card and detachable recipe card, in accordance with the present invention.

FIG. 1 shows a preferred embodiment of the greeting card 30 of the invention, a bifold card with double-layer panels glued together from heavy paper, light paperboard, plastic, foil, or other conventional card material. The bifold crease line 312 separates the two panel halves 31 and 32. Panel 32 (and also panel 31) may include indicia W in the form of text, pictures, or both, especially messages related to food when the theme is intended to be culinary, on the inside or outside surface thereof.

As indicated above, panel halves 31 and 32 are preferably of double thickness, i.e., two cards glued together, so that portions can be cut from the panel from the inside of the card without being visible at the exterior of the greeting card 30. A pop-up section 35 is cut from the outer layer of panels 31 and 32 on the inside of the greeting card 30. The lines 60 and 62, at which the pop-up section remains connected to the remainder of the panels 31 and 32, are creased and preferably scored to improve the ease of creasing. A third crease line 64 is also on the pop-up section, preferably at the same distance from the crease line 60 on the panel 31 as the crease line 62 on panel 32 is from the bifold crease line 312 of the greeting card 30. In this manner, when the card is closed, the pop-up section folds along crease lines 60, 62 and 64 so as to lie flat within the card. However, when greeting card 30 is opened to the position shown in FIG. 1, the two portions 33 and 34 of the pop-up section 35 rise up to the illustrated position. While the illustrated manner of forming the pop-up section 35 is preferred, it should be understood that any known means of forming pop-up sections may be used in the construction of the card as long as the pop-up section 35 traverses the thematic card 10. The pop-up portion 34 preferably in the shape of a figure F, such as a figure related to cooking when the theme is a culinary one.

A thematic card 10, such as a recipe card, preferably a single-panel card of paperboard, is held within the greeting card 30 by tabs T and also by the pop-up portions 33 and 34, which enclose the recipe card 10. The recipe card 10 preferably measures 3 inches wide by 5 inches high (7.6 by 12.7 cm), so that it may be stored along with other recipe cards of similar size. The greeting card 30 is larger so that the recipe card 10 can be held inside without protruding.

The recipe card 10 includes a recipe on the front side visible in FIG. 1. Culinary indicia I10, most preferably a picture of food prepared according to the recipe on the front side of the card, is the preferred indicia on the back side. The picture and/or recipe I10 may be printed in full color from a photograph, preferably on glossy stock so that food spills can more easily be wiped from the card during cooking.

The preferred means for holding the card 10 against the inside layer of the panel 31 are the illustrated tabs T, made by cutting a semi-circular slit through the surface layer of the two-layer panel on the inside of the card 30 before gluing the two layers together. The slit may be located at the corners of the recipe card 10 instead of at the sides as shown, and then preferably are straight. The partial cut-out from the same layer, which forms the pop-up section 35, is also preferably done before gluing the two layers together.

Figure 2:
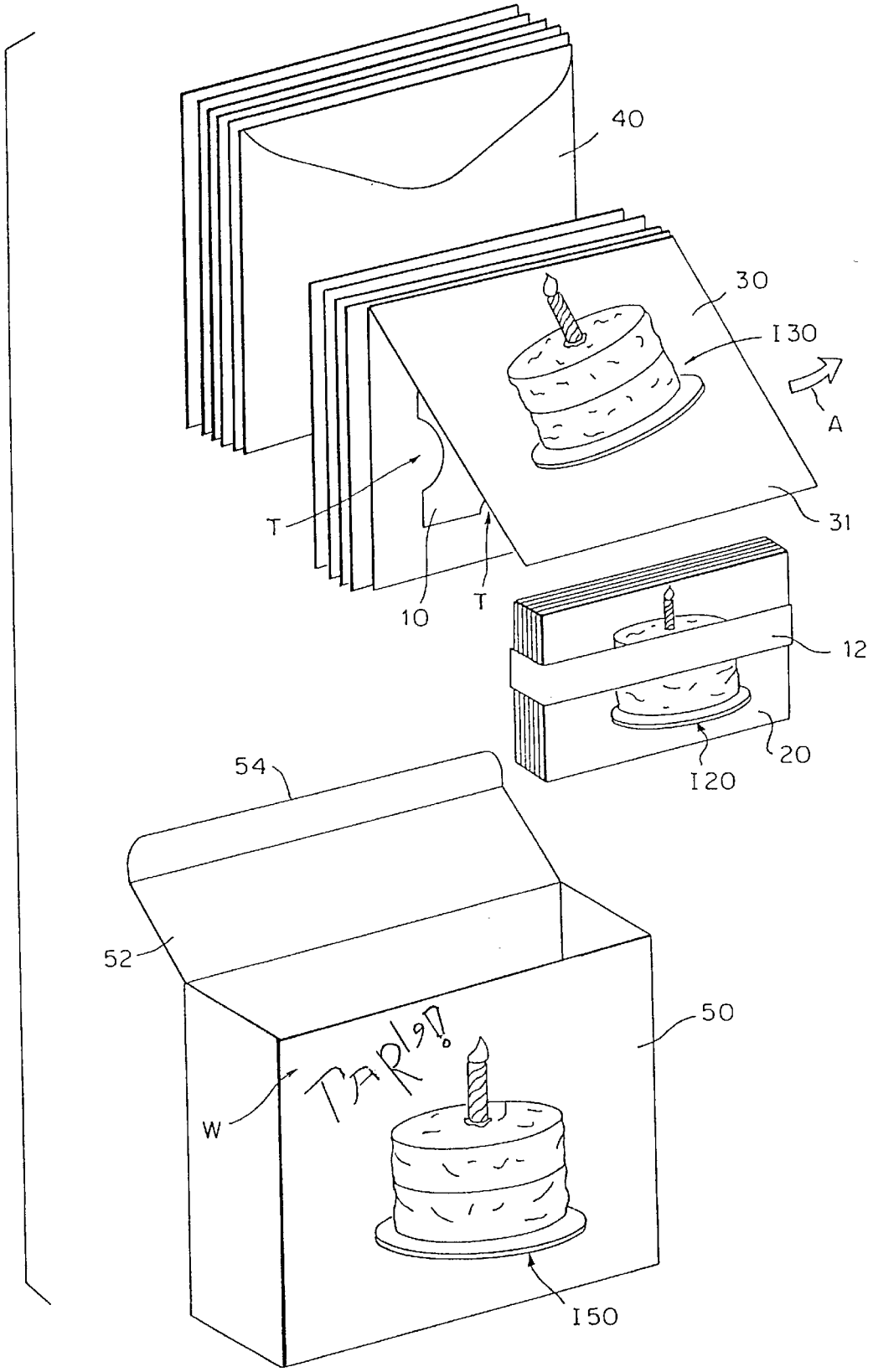
FIG. 2 is an exploded perspective view of a kit in accordance with the present invention.

FIG. 2 shows a group of the greeting cards 30 aligned for insertion into a box 50 having a hinged cover 52 and a locking flap 54 of any type; however, the panel 31 of the front-most card 30 is opened in the direction shown by arrow A, for illustrative purposes. Tabs T holding the recipe card 10 are visible inside. The outer surface of the front greeting card panel 31 bears indicia I30. Preferably, the indicia I30 on the front of each card corresponds to the indicia I10 on the recipe card therein.

A packet of duplicate recipe cards 20 is also shown in FIG. 2, banded together by a suitable band 12, e.g., of paper or plastic film. The front-most of these duplicate cards 20 bears culinary indicia I20. Indicia on the others is hidden in FIG. 2. Each card in the kit preferably contains a different recipe and corresponding indicia.

Also shown in FIG. 2 are a group of envelopes 40 sized to accept the greeting cards 30, and equal in number to them; the box 50 is sized to accept the envelopes 40, cards 30 with enclosed recipe cards 10, and packet of extra recipe cards 20. The box 50 may bear indicia I50 and writing W. The box and various card sets shown in FIG. 2 comprise a kit for sending greetings and recipes.

Preferably, the indicia I10, I20, and I30 all are similar or visually related pictures, merely differing in scale between the larger greeting card 30 and smaller recipe cards 10, so that the food pictures are similarly framed.

The boxed kit may include several complete sets each comprising one envelope 40, one greeting card 30, one recipe card 10, and one duplicate recipe card 20, all bearing the same picture. In this case the recipes on the two cards 10 and 20 would also be alike. While the invention comprehends a kit in which all the sets have the same recipe and food picture, the preferred kit is that in which each set (envelope, greeting card, and two recipe cards) is related to one particular food item, which is different from the food item of all other sets. For example, the top greeting card 30 of the group shown in FIG. 2 may bear a picture of a candle cake, as shown in the drawing, and the top-most the recipe cards 10 and 20 also bear the same picture; but the next-down recipe card 20 and greeting card 30 in their groups will bear a different picture and the different recipe for preparing the different food item shown.

The message written on the greeting card may be a birthday, thank you, thinking-of-you, get well, etc., message, preferably fitting with the culinary or other theme. The boxed set may contain cards of differing types, i.e., birthday, get well, etc., so that the purchaser of the boxed set can select the appropriate card set for the appropriate occasion.

By this arrangement, the user of the kit can send a different recipe and card each time, while transferring the packet of cards 20 from the box 50 to her or his personal recipe file.

If each set has a different picture, then the box 50 may include the same picture as is on one of the sets, as shown in FIG. 2, or, it may bear indicia not found on any of the sets.

While the preferred embodiment of the present invention has been described with respect to recipe card and food related indicia, it should be understood that the present invention is not intended to be limited to a food related theme. Other thematically interrelated forms can be used. For example, the cards may have a religious theme with each of the thematic cards being a particular prayer, bible passage or religiously related picture, the pop-up figure enclosing the thematic card may have a religious significance such as a religious symbol or other icon, and the front of the greeting card may have a picture or message which is related to the prayer or other message on the thematic card. The recipient may wish to remove the thematic card and keep it in his or her wallet or post it where it can be frequently referred to for spiritual solace. The sender can keep a duplicate set of the thematic cards for the same purpose.

Similarly, the thematic card may be a business card of an individual in a company or firm with the figure on the pop-up being emblematic of that company or firm and the picture on the front of the greeting card perhaps being a photograph of the person whose business card is inside.

Furthermore, while the thematic card is being described as a rectangular single-panel card, it need not be single-panel and may itself be folded with the entire folded card being held within the tabs. It may also be of any shape which fits with the outer dimensions of the greeting card when closed. Furthermore, the greeting card need not be rectangular but can have any shape.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. In combination:

a thematic card having a dimension;

a greeting card including at least one panel larger than the dimension of the thematic card, the panel including holding means for holding the thematic card thereon, such that the thematic card may be held within the greeting card, such greeting card further including a pop-up section traversing a space over the thematic card, whereby the thematic card is disposed between the pop-up section and a panel of the greeting card.

2. The combination according to claim 1, wherein the thematic card is a recipe card.

3. The combination according to claim 1, wherein the greeting card and the thematic card include similar thematic indicia.

4. The combination according to claim 2, wherein the pop-up section is a culinary figure.

5. The combination according to claim 3, wherein the indicia is culinary indicia.

6. The combination according to claim 1, wherein said pop-up section constitutes a part of said holding means.

7. The combination according to claim 1, wherein the greeting card includes doubled, adhered sheets and wherein the holding means includes tab means not visible on the outside of the greeting card when the greeting card is folded into a closed position.

8. The combination according to claim 1, wherein said greeting card is a bifold card and said holding means, and said pop-up section are disposed on the interior of the said greeting card when closed.

9. A kit comprising:

a plurality of thematic cards, each said thematic card having a same dimension, and each having different indicia thereon all relating to the theme of said thematic cards;

a plurality, equal to the number of said thematic cards, of greeting cards, each said greeting card including at least one panel larger than the dimension of the thematic card, one panel of each said greeting card including holding means for holding the thematic card thereon, such that the thematic card may be removably held within said greeting card, each said greeting card having different indicia thereon, all relating to the theme of said thematic cards;

a plurality, equal to the number of the greeting cards and the thematic cards, of envelopes sized to accept the greeting cards; and a box sized to accept the plurality of greeting cards, the plurality of thematic cards, and the plurality of envelopes;

wherein the indicia on each of said greeting cards has a commonality to the indicia on a corresponding one of said thematic cards.

10. The kit according to claim 9, wherein the thematic cards are recipe cards, each having a different recipe thereon.

11. The kit according to claim 10, wherein the indicia on each of said greeting cards comprises a picture of the food product of the corresponding recipe card.

12. The kit according to claim 9, further including a packet of extra thematic cards comprising a duplicate of each of said plurality of thematic cards.

13. The kit according to claim 9, wherein each said greeting card is a bifold card and said holding means is disposed on the interior of said greeting card when closed.

14. The kit according to claim 13, wherein said pop-up section constitutes a part of said holding means.

15. The kit according to claim 13, wherein each said greeting card includes a pop-up section traversing a space over the thematic card, whereby the thematic card when held by said holding means, is disposed between said pop-up section and a panel of said greeting card.

* * * * *